US006302761B1

(12) United States Patent
Wrenn

(10) Patent No.: US 6,302,761 B1
(45) Date of Patent: Oct. 16, 2001

(54) BRASSIERE

(76) Inventor: Lydia Hay Wrenn, 2950 Bedford Dr., Merced, CA (US) 95340

( * ) Notice: Subject to any disclaimer, the term of this patent is extended or adjusted under 35 U.S.C. 154(b) by 0 days.

(21) Appl. No.: 09/659,101

(22) Filed: Sep. 11, 2000

(51) Int. Cl.[7] ..... A41C 3/00

(52) U.S. Cl. ..... 450/86

(58) Field of Search ..... 450/86, 71, 77, 450/1, 2, 36, 53, 58, 63; 2/73, 104, 109, 113, 328, 327, 44, 45

(56) References Cited

U.S. PATENT DOCUMENTS

| | | | | |
|---|---|---|---|---|
| 266,008 | * | 10/1882 | Banfield . | |
| 525,241 | * | 8/1894 | Tucek . | |
| 1,213,386 | * | 1/1917 | Lamothe . | |
| 1,406,692 | * | 2/1922 | Smith . | |
| 1,906,732 | * | 5/1933 | Arnold . | |
| 2,121,088 | * | 6/1938 | La Rue | 2/42 |
| 2,317,664 | * | 4/1943 | Becker et al. | 2/42 |
| 2,400,499 | * | 5/1946 | Gerace | 2/42 |
| 2,402,835 | | 6/1946 | Nagy . | |
| 2,455,036 | * | 11/1948 | Boylan | 2/42 |
| 2,493,179 | | 1/1950 | Wittenberg . | |
| 2,732,561 | * | 1/1956 | Starr | 2/305 |
| 2,777,134 | * | 1/1957 | Kaufman | 2/301 |
| 2,817,089 | * | 12/1957 | Oelbaum | 2/42 |
| 2,869,552 | * | 1/1959 | Smith | 128/456 |
| 3,040,750 | * | 6/1962 | Hurwitz | 128/482 |
| 3,071,140 | * | 1/1963 | Adler | 128/510 |
| 3,421,514 | * | 1/1969 | Friedlander | 128/454 |
| 3,439,682 | * | 4/1969 | Defru | 128/460 |
| 3,623,487 | | 11/1971 | Chiu . | |
| 3,628,539 | * | 12/1971 | Fredricks | 128/427 |
| 3,763,865 | | 10/1973 | DeFru . | |
| 3,908,670 | * | 9/1975 | Dubin | 128/482 |
| 4,220,157 | * | 9/1980 | Clark et al. | 128/510 |
| 4,325,378 | * | 4/1982 | Wilkinson | 128/501 |
| 4,552,144 | | 11/1985 | Selvaggi . | |
| 4,804,351 | * | 2/1989 | Raml et al. | 450/58 |
| 4,995,847 | * | 2/1991 | Hwang | 450/71 |
| 5,098,331 | * | 3/1992 | Corrado | 450/58 |
| 5,152,741 | * | 10/1992 | Farnio | 602/79 |
| 5,162,015 | | 11/1992 | Otani . | |
| 5,221,227 | * | 6/1993 | Michels | 450/1 |
| 5,538,502 | * | 7/1996 | Johnstone | 602/79 |
| 5,560,046 | * | 10/1996 | Iwamasa et al. | 2/328 |

(List continued on next page.)

OTHER PUBLICATIONS

Article from the Wall Street Journal, dated Apr. 10, 2000, title "Braw–wl" by Rebecca Quick, 2 pages.
Sears Catalog Shop At Home Plus Size, dated Mar. 3, 2000, 1 page (vol. 612—Spring 2000 catalog).
Nov. 2000, Mervyn's Brassiere Ad.

*Primary Examiner*—John J. Calvert
*Assistant Examiner*—Alissa L. Hoey
(74) *Attorney, Agent, or Firm*—Mark D. Miller

(57) ABSTRACT

An improved brassiere is disclosed that provides a high level of comfort, wide ranging adjustability and improved breast support while minimizing fatigue and improving the posture of the user using a support system which includes strategically attached shoulder straps which cross in the back at a unique swivel. Each shoulder strap is detachably attached at one end to the top of a breast cup, and attached at the opposite end to the side of the opposite cup. An adjustable coupling is provided between the cups. The adjustable swivel includes a pair of pivotally attached short flat hollow sleeves for slidably receiving the shoulder straps. Because the shoulder straps are slidably disposed in the sleeves of the swivel, it will move up or down slightly as the wearer moves, stretches, bends over, etc. In the preferred embodiment, no boning, wire or elastic is used. Instead, cotton piping is used around the lower breast cups for support, wide cotton belting is used for the straps, and the entire framework of the brassiere is constructed of a sturdy cotton fabric that is interlined with fusible fleece and lined with cotton flannel for comfort.

12 Claims, 4 Drawing Sheets

U.S. PATENT DOCUMENTS 5,624,296 * 4/1997 Weber-Unger ..... 450/36
5,662,512 * 9/1997 Cohen ..... 450/1
5,823,851 * 10/1998 Dicker ..... 450/2
5,951,364 9/1999 Brown et al. .
6,023,785 * 2/2000 Johnson ..... 2/62
6,125,475 * 10/2000 Taylor ..... 2/333
6,165,045 * 12/2000 Miller et al. ..... 450/1
6,168,498 * 1/2001 Wagner ..... 450/58
6,200,194 * 3/2001 Grier ..... 450/64

* cited by examiner

BRASSIERE

BACKGROUND OF THE INVENTION

1. Field of the Invention

The present invention relates to feminine undergarments, and more particularly to an improved brassiere providing comfort, adjustability and support while minimizing fatigue and improving the posture of the user.

2. Description of the Prior Art

A wide variety of brassiere designs are known in the prior art. Unfortunately, many if not most available brassieres suffer from numerous shortcomings. Many brassieres are uncomfortable to wear in that their thin straps, support wires, bones and/or elastic parts poke, dig or cut into the skin of the wearer. Other brassieres are difficult to adjust or severely limited in their available adjustment, requiring the user to endure discomfort or improper fit while wearing. Numerous brassieres do not provide proper support, leading to unbalanced weight distribution, and the potential for chafing and skin rashes. Many brassieres are not made from durable or long lasting materials, or they wear unevenly, resulting in the exposure of such things as the support wires, bones and/or pins, as well as the loss of elasticity and shape.

Most brassieres have thin straps that go directly over the shoulders to a back strap, with adjustment buckles on the shoulder straps. Such designs limit the available range of adjustment and only provide support at the top of the breast cups. The chest-encircling belt of many brassieres is fastened together in the back, while others are fastened between the breast cups. Donning brassieres with back fasteners usually involves wrapping the belt around the chest and fastening it together in front where the user can see it, and then sliding the brassiere 180° to move the fastener to the back. This exercise may result in painful rubbing, chafing or worse. Many brassieres are made of synthetic materials that do not ventilate well potentially resulting in excess perspiration leading to rashes and chafing.

It is therefore desirable to provide a durable, comfortable and adjustable brassiere providing adequate and balanced breast support that is made from breathable materials without the use of wires, bones or elastic. The present invention provides such an improved brassiere design that overcomes many of the drawbacks of existing brassiere while at the same time improving the posture and well being of the wearer.

SUMMARY OF THE INVENTION

The present invention is an improved brassiere that provides a high level of comfort, wide ranging adjustability and improved breast support while minimizing fatigue and improving the posture of the user. The support system of the present invention precludes sagging or flapping and elevates the breasts while simultaneously balancing and securing them very close to the chest. This configuration alters the center of gravity and redistributes the weight of the user in a manner that avoids chafing and heat rash, and improves the posture and general well being of the user.

The improved brassiere of the present invention includes a pair of breast cups having an adjustable detachable coupling between them. The inside edge of each cup is attached to the coupling; the outside edge of each cup is attached to a first end of two independent shoulder straps. The configuration of the two shoulder straps provides dual support of the weight of the breasts. The attachment of the first end of each shoulder strap is at an angle pointing directly to a roll of cotton piping in the cup that supports the weight of each breast. Each strap then wraps under the arm, across the back and over the opposite shoulder where it is adjustably attached to the top framework of the opposite cup. By this design, each shoulder strap lifts and pulls back from the bottom of one cup while simultaneously pulling up on the other cup. Each of the two shoulder straps moves and provides support independently of the other since they are not attached to each other. This configuration of shoulder straps is more efficient in that the action of adjusting a strap flows directly to the targeted area without restriction or diversion by any stitching or fastening, particularly where the straps cross in the back.

A unique swivel acts as a guide for the straps where they cross in the back. The swivel includes two hollow sleeves that are pivotally attached to each other. One of the two shoulder straps is slidably disposed in each sleeve. This configuration allows the straps to adjust their position when a strap is shortened or lengthened by the user to obtain the most comfortable fit. Each strap can slide within its sleeve or rotate about the pivot without affecting the other strap or sleeve. The swivel also provides stability and prevents twisting and tangling of the straps. The swivel combined with the front coupling allows easy entry and removal of the garment. The guides of the swivel also create a breathing space between the straps and the user's body that reduces abrasion or pressure.

A third adjustable strap across the lower back functions independently of the shoulder straps and serves as an anchor that prevents the cups from slipping up and over the breast in the event of sudden movement or excessive tightening of the shoulder straps. The front coupling is adjustable, allowing different widths of separation between the cups to obtain the most comfortable fit. A plurality of snaps and/or hooks and eyes, a plurality of hooks and loops (Velcro®), or other suitable fasteners are used to secure the coupling.

In use, the swivel guide mechanism normally rests against the spine in the shoulder area. Because the shoulder straps are slidably disposed in the sleeves of the swivel, it will move up or down slightly as the wearer moves, stretches, bends over, etc. Slumping by the wearer causes the straps to tighten and the swivel guide to be pressed against the spine. A natural reaction to this increased pressure is for the wearer to sit up straighter, push the shoulders back, and bend forward from the hips. Thus, the design of the present invention assists the wearer in improving posture.

In the preferred embodiment of the present invention no boning, wire or elastic is used. Instead, 22/32-inch cotton piping is used around the lower breast cups for support. This material is soft, yet firm, and fits into the natural curve of the body where the lower breast abuts the rib cage. Wider, sturdier cotton belting up to 1½ inches wide is preferred for the straps, as opposed to the smaller more conventional ½" straps. This wider and stronger cotton belting disperses the weight over a wider area, thus reducing the pressure against the body and providing greater support of the weight. Duck cloth (similar to canvas) is preferred to reinforce strap attachments and buffer the wearer from the hardness of the metal D-rings used to fasten and adjust the straps. Duck cloth is also preferred to support the snaps and hook and eye closures of the front coupling. It is preferred that the entire framework of the brassiere of the present invention be constructed of a sturdy cotton fabric that is interlined with fusible fleece and lined with cotton flannel to buffer the pressure of the support network. This provides a soft, absorbent surface against the body without compromising the firmness required for adequate support. Synthetic, stretch materials provide very little support and lack ventilation needed for comfort.

It is therefore a primary object of the present invention to provide an improved brassiere for supporting and elevating the breasts while balancing and securing them close to the wearer's chest.

It is another important object of the present invention to provide a brassiere which improves the posture and overall well being of the wearer through a pair of uniquely attached adjustable shoulder straps which cross in the back through a unique swivel such that slumping by the user presses the swivel against the wearer's back urging the wearer to improve posture.

It is a further object of the present invention to provide an improved brassiere having a pair of adjustable shoulder straps which cross in the back, one end of each strap being adjustably attached to the top of one of the breast cups, the other end of each strap being attached in the vicinity of the outside edge of the other breast cup.

It is further object of the present invention to provide an improved brassier having a swivel made of a pair of pivotally attached hollow sleeves for slidably receiving the adjustable shoulder straps of the brassiere where they cross in the back.

It is another object of the present invention to provide a comfortable, durable improved brassiere made without any wires, bones or elastic.

Additional objects of the invention will be apparent from the detailed descriptions and the claims herein.

DETAILED DESCRIPTION OF THE DRAWINGS

Figure 1:
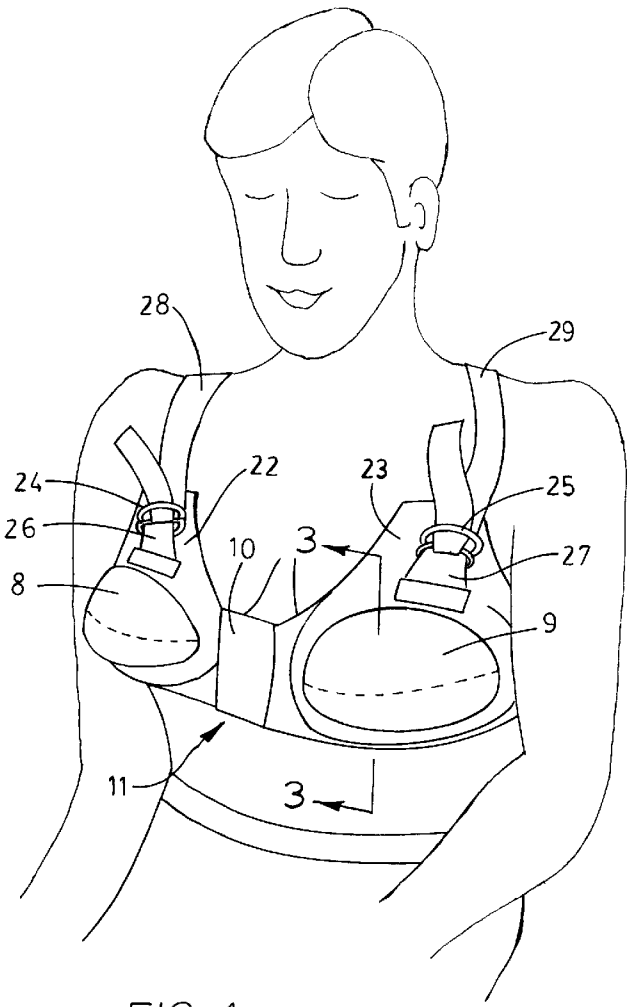
FIG. 1 is a perspective environmental front view of a user wearing the brassiere of the present invention.
Figure 4:
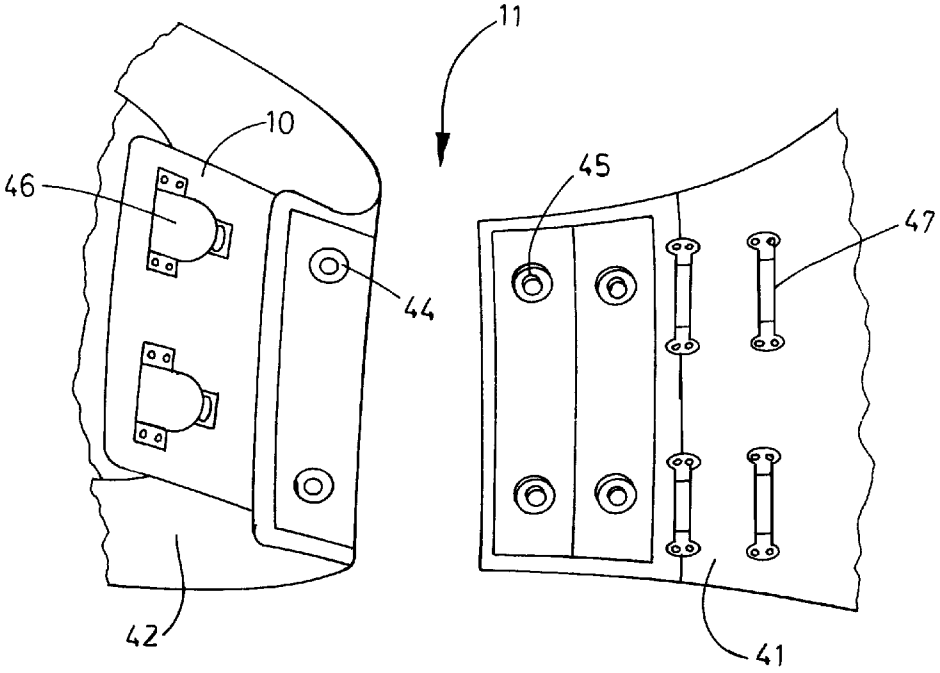
FIG. 4 is an enlarged isolated view of a breast cup coupling for the present invention.
Figure 3:
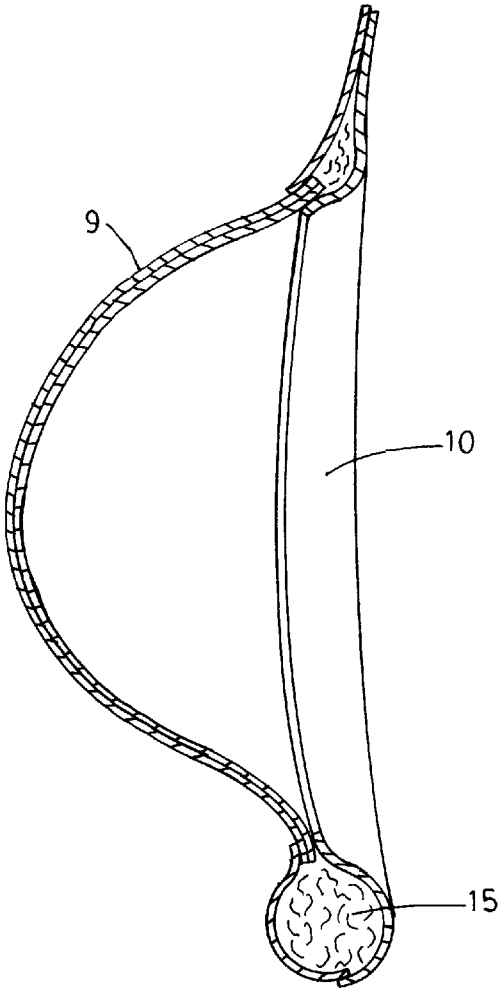
FIG. 3 is a cross sectional view of a breast cup of the present invention along line 3—3 of FIG. 1.

Referring to the drawings wherein like reference characters designate like or corresponding parts throughout the several views, and referring particularly to FIGS. 1, 3, and 4 it is seem that the invention includes a pair of breast cups 8, 9 separated by a detachable coupling 11 provided between the breast cups for attaching them together. Coupling 11 includes a first panel 41 attached to the inside edge of one of breast cups 8 or 9, and a second panel 42 attached to the inside edge of the other breast cup. Referring to FIG. 4, it is seen that panel 41 includes a plurality of engagement part such as snaps 45, eyes 47, Velcro hooks (not shown) or other suitable receptors for the corresponding engagement parts on panel 42 such as snaps 44, hooks 46, Velcro loops (not shown) or other suitable engagement parts. A flap 10 is provided on panel 42 to cover the engagement parts when coupled together. In FIG. 3, it is seen that the bottom of each breast cup 8, 9 is reinforced with cotton piping 15 for support.

Figure 2:
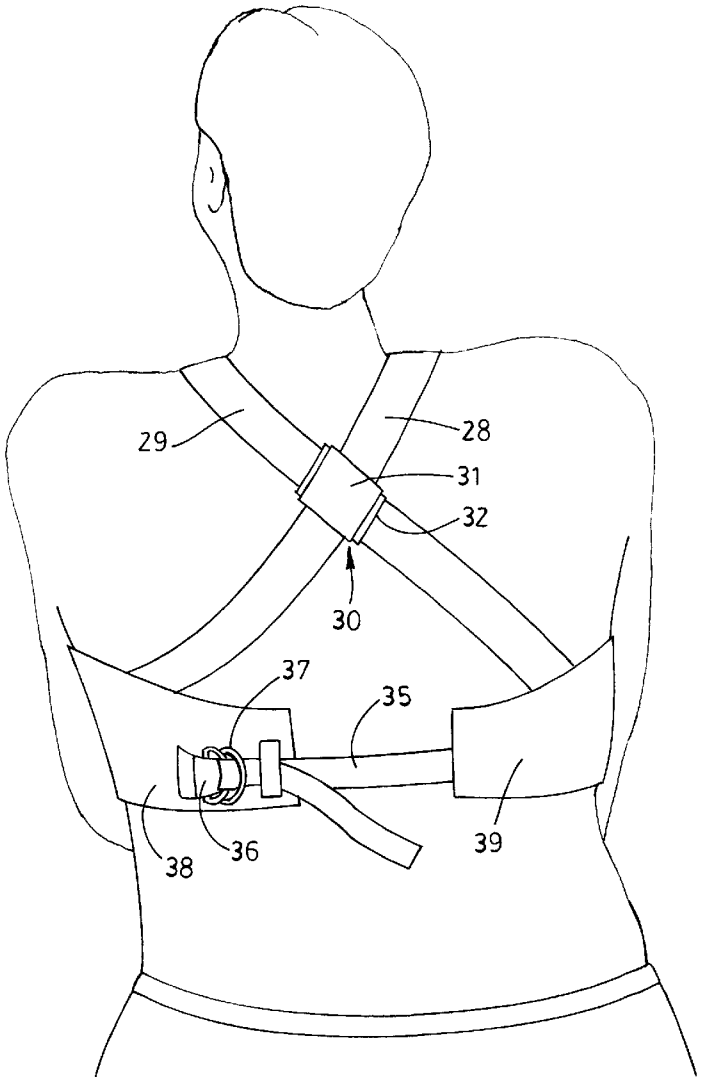
FIG. 2 is a back view of a user wearing brassiere of the present invention.
Figure 6:
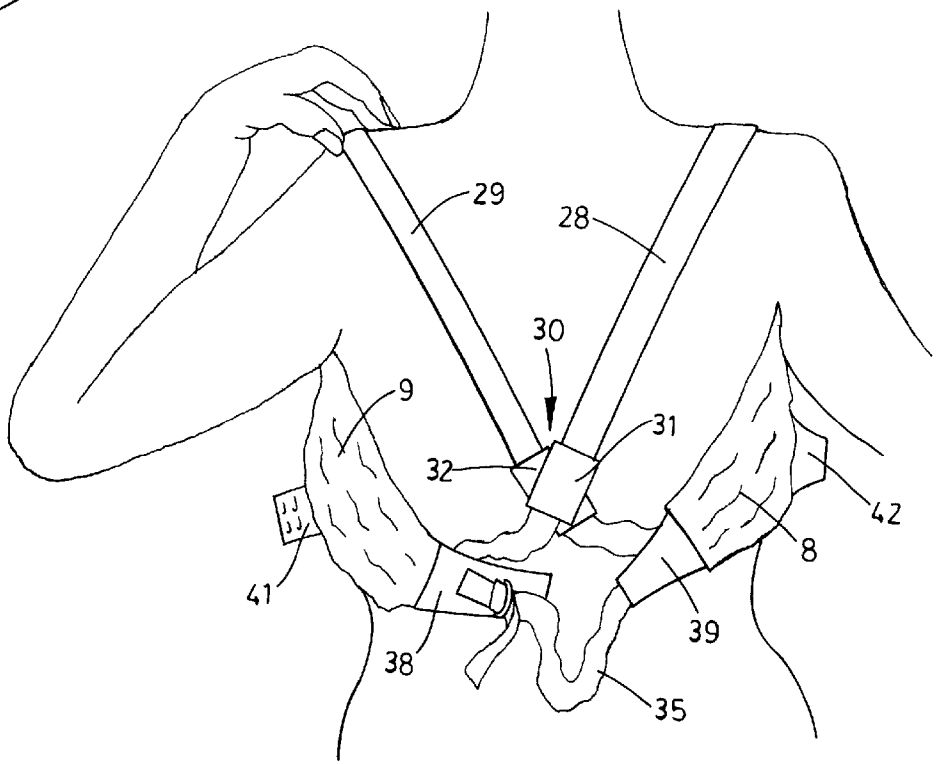
FIG. 6 is a back view of a user donning the brassiere of the preset Invention.
Figure 5:
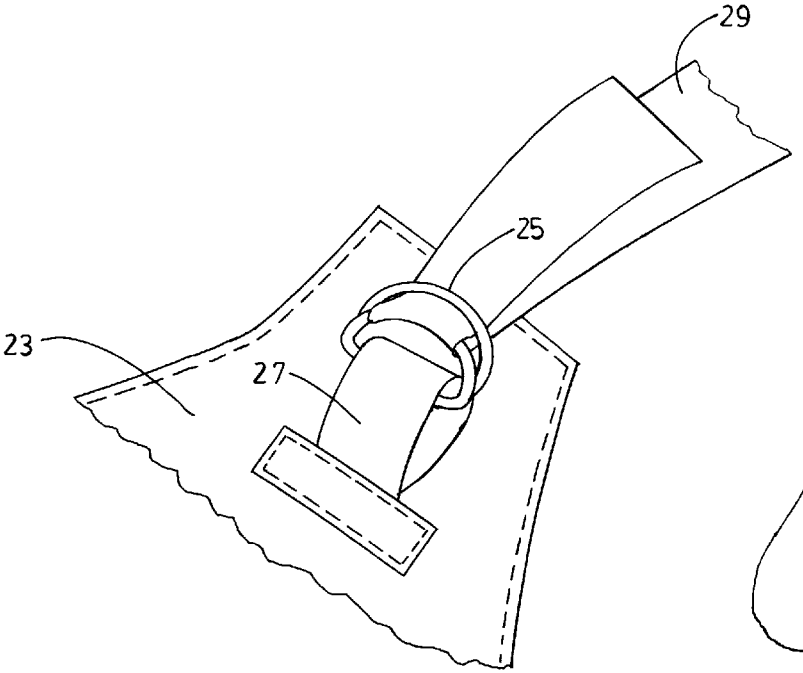
FIG. 5 is an enlarged isolated view of the attachment of an adjustable strap above one of the breast cups.
Figure 7:
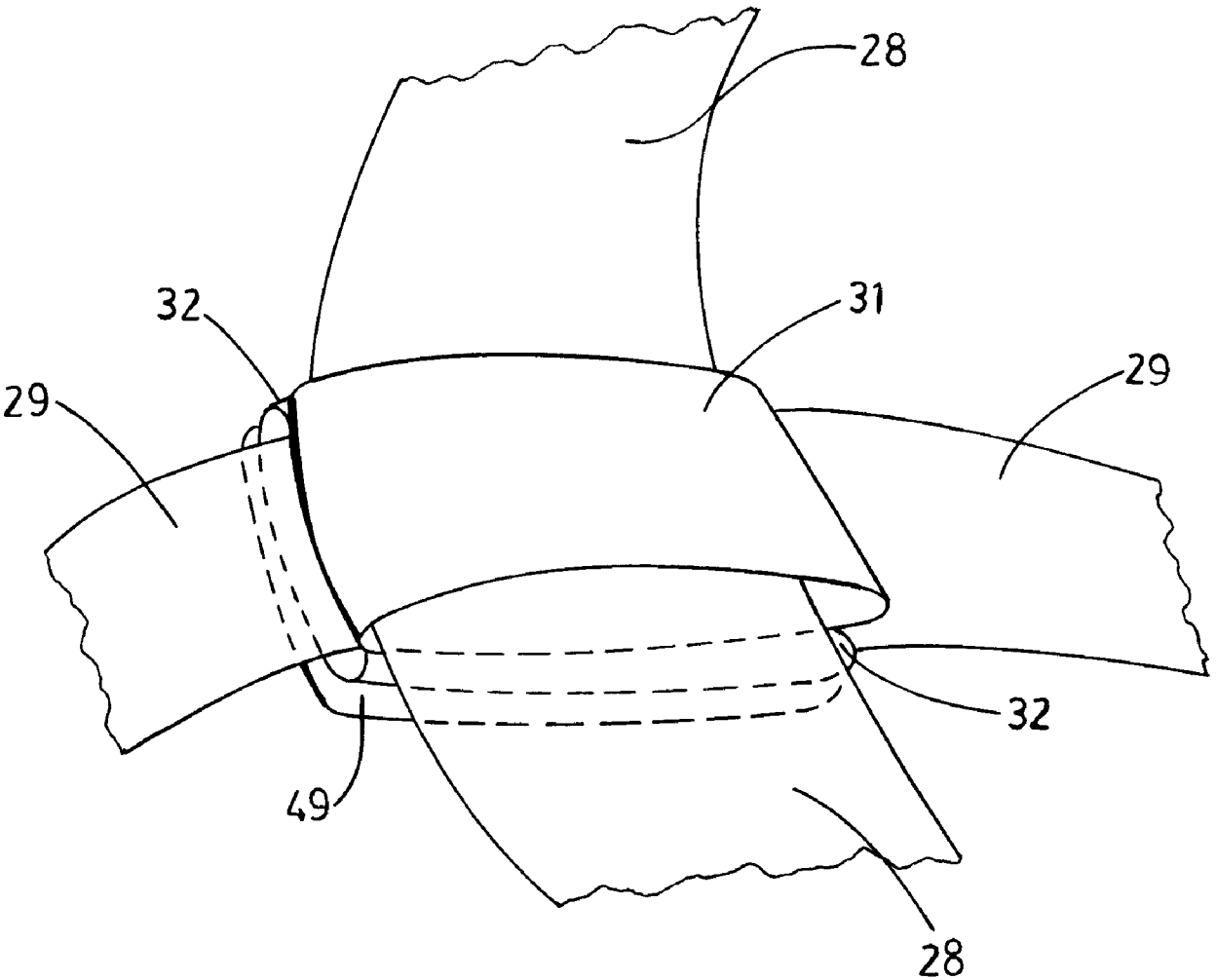
FIG. 7 is an enlarged view of the swivel of the present invention.
Figure 4:
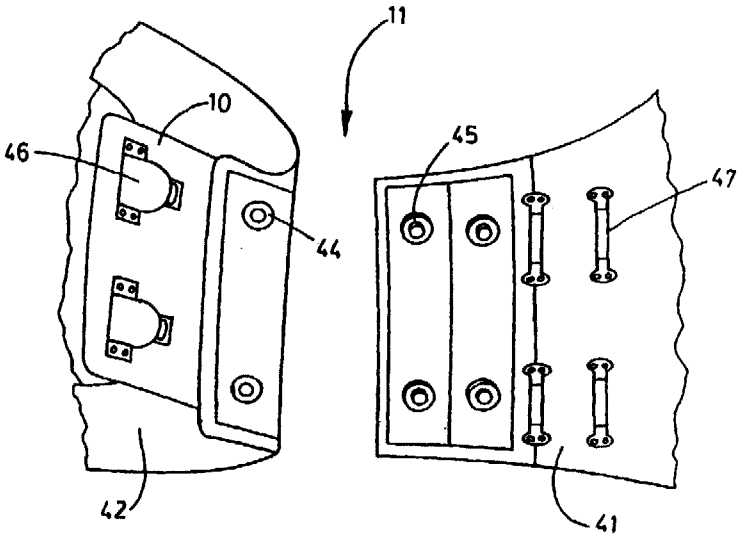

Referring to FIGS. 1 and 5, it is seen that the upper portion of each breast cup 8, 9 is attached, respectively, to a panel 22, 23. Each panel 22, 23 includes, respectively, an anchor 26, 27 to which one end of shoulder straps 28, 29 are adjustably attached. D-rings 24, 25, or other suitable adjustment means, are provided, respectfully, on each anchor 26, 27 for adjustment of straps 28, 29. The opposite ends of shoulder straps 28, 29 are attached, respectively, to the tops of rear panels 38, 39 as shown in FIGS. 2 and 6. The angle of attachment of straps 28, 29 to the tops of rear panels 38, 39 is such that tightening straps 28, 29 pulls opposite breast cups 9, 8 against the chest of the wearer. This same tightening of straps 28, 29 pulls up on breast cups 8, 9.

Shoulder straps 28 and 29 cross at the back. A swivel 30 is provided at this intersection of shoulder straps 28 and 29. Swivel 30 includes a pair of flat sleeves 31 and 32 pivotally attached to each other in an overlapping relationship. Shoulder strap 28 is slidably disposed in sleeve 31 of swivel 30; and strap 29 is slidably disposed in the other sleeve 32 of swivel 30. An adjustable lower back strap 35 is provided between the inside edges of rear panels 38, 39. One end of strap 35 is adjustably attached to anchor 36 on one of rear panels 38, 39; and the opposite end of strap 35 is attached to the other of rear panels 38, 39. D-ring 37 or other suitable adjustment means, is provided on anchor 36 for adjustment of strap 35.

To don the brassiere of the present invention, the front coupling 11 is opened, and all strap closures 24, 25 and 37 are loosely fastened. The right arm is first placed through the right shoulder loop formed by strap 28. Then the left shoulder strap 29 is brought across the back and the left arm placed through the left shoulder loop formed by strap 29. Cups 8, 9 are placed around the breasts so that each breast fits comfortably, with the position of the front coupling 11 adjusted accordingly. Panels 41 and 42 are engaged closing front coupling 11. The shoulder straps 28, 29 are then adjusted so that the fiber piping 15 supporting the cup 8, 9 fits into the curve under the breast where it protrudes from the chest and the lower cup slants upward. Straps 28, 29 should be firm against the shoulders but not tight. The swivel 30 will slide to the middle (compare FIG. 6 to FIG. 2) as these adjustments are made. Finally, the lower back strap 35 is adjusted close against the sides but not so tight as to cause pressure against the rib cage.

DESCRIPTION OF THE PREFERRED EMBODIMENTS

In the preferred embodiment, no wires, bones or elastic is used. Each of panels 38, 39, 41 and 42 is preferably reinforced with duck cloth or the like to provide strength and durability at points of stress, Cotton piping 15 is preferably in the form of a soft cord to be wrapped in fusible fleece or equivalent interlining and suitable lining material. Padding 49 is preferably provided on back of swivel 30 where it makes contact with the user's back. Straps 28, 29 and 35 have a width of no less than one inch, and preferably larger (1¼ or 1½ inches). It is also preferred that the breast cups 8 and 9 have a firm interlining in lower cup and the entire cups be lined to cover seams and interlining. Panels 38, 39, 41 and 42 of the garment should have an interlining of fusible fleece, or equivalent, for softness.

It is to be understood that variations and modifications of the present invention may be made without departing from the scope thereof. It is also to be understood that the present invention is not to be limited by the specific embodiments disclosed herein, but only in accordance with the appended claims when read in light of the foregoing specification.

I claim:

1. An improved brassiere comprising first and second brassiere cups, a detachable coupling between said cups, an adjustable back strap detachably connected to said cups opposite said coupling, first and second adjustable shoulder straps, one end of each shoulder strap being detachably connected to the top of one of said cups and extending over the shoulder of the user, the opposite end of each strap being connected to the side of said other cup such that said shoulder straps cross in the back, and a swivel provided at the intersection of said shoulder straps.

2. The brassiere of claim 1 wherein padding is provided on the swivel where it touches the back of the user.

3. The brassiere of claim 2 wherein said coupling comprises a plurality of snaps.

4. The brassiere of claim 2 wherein said coupling comprises a plurality of hooks and eyes.

5. The brassiere of claim 2 wherein said coupling comprises a plurality of interengaging hooks and loops.

6. The brassiere of claim 2 wherein strap anchors are provided at the tops of each of said cups, each anchor including a pair of metal rings for engagement with said corresponding shoulder strap.

7. The brassiere of claim 6 wherein a strap anchor is provided at one end of said back strap, said anchor including a pair of metal rings for engagement with said back strap.

8. The brassiere of claim 7 wherein reinforcing duck cloth is provided at the connections of all of said straps to said cups.

9. The brassiere of claim 8 wherein said back and shoulder straps are made of cotton having a width of between 1¼ and 1½ inches.

10. The brassiere of claim 9 wherein supportive cotton piping is used around the lower edges of said cups.

11. The brassiere of claim 10 wherein said cups and duck cloth portions are interlined with fusible fleece and lined with cotton flannel.

12. The brassiere of claim 11 wherein the framework surrounding and supporting said cups, including areas where duck cloth reinforcement is present, are interlined with fusible fleece and lined with soft absorbent fabric; and wherein the lower portions of said cups are interlined with a firm interlining; and wherein each of said cups is entirely lined with a supple cotton fabric.

* * * * *

UNITED STATES PATENT AND TRADEMARK OFFICE

CERTIFICATE OF CORRECTION

PATENT NO. : 6,302,761 B1
DATED : October 16, 2001
INVENTOR(S) : Lydia Hay Wrenn It is certified that error appears in the above-identified patent and that said Letters Patent is hereby corrected as shown below:

Drawings,
Sheet 2 of 4, Figure 3, delete delineated area labeled 10.

Column 1,
Line 44, replace "brassiere" with -- brassieres --.

Column 3,
Line 53, replace "seem" with -- seen --.
Line 59, replace "part" with -- parts --.

Signed and Sealed this

Twenty-third Day of April, 2002

*Attest:*

*Attesting Officer*

JAMES E. ROGAN
*Director of the United States Patent and Trademark Office*

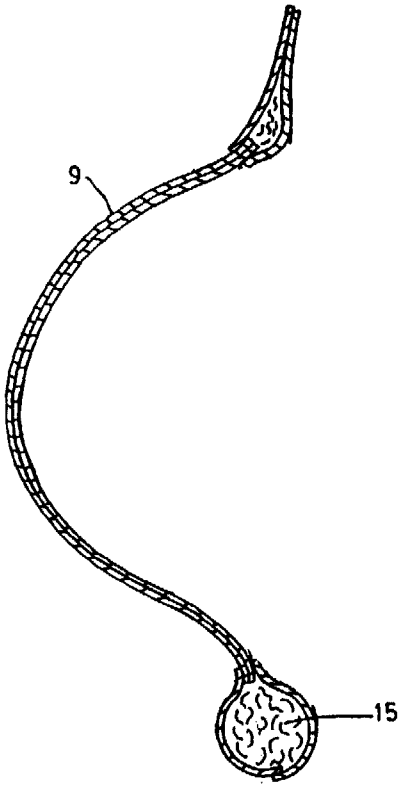
FIG. 3
AMENDED